United States Patent [19]

Bursik

[11] Patent Number: 5,042,795

[45] Date of Patent: Aug. 27, 1991

[54] INTERCHANGEABLE DUAL POSITION TRAINING STAND AND WORK STAND FOR BICYCLISTS

[76] Inventor: Thomas A. Bursik, 1427 W. King St., Owosso, Mich. 48867

[21] Appl. No.: 413,740

[22] Filed: Sep. 28, 1989

[51] Int. Cl.[5] ..... A63B 69/16

[52] U.S. Cl. ..... 272/73; 272/132

[58] Field of Search ..... 272/73, 73.1, 69, 73.2, 272/132; 211/17, 20, 21, 22, 23, 24; 269/77, 78, 88, 296, 901, 906

[56] References Cited

U.S. PATENT DOCUMENTS

| | | | |
|---|---|---|---|
| 589,705 | 9/1897 | Dwyer | 272/73.1 |
| 674,391 | 5/1901 | Baker | 272/69 |
| 2,043,977 | 6/1936 | Back | 272/73.1 |
| 3,724,844 | 4/1973 | Olmstead et al. | 272/73.1 |
| 4,441,705 | 4/1984 | Brown | 272/73.1 |
| 4,938,475 | 7/1990 | Sargeant et al. | 272/73 |

FOREIGN PATENT DOCUMENTS

| | | | |
|---|---|---|---|
| 2454821 | 12/1980 | France | 272/73 |

*Primary Examiner*—Stephen R. Crow

*Assistant Examiner*—L. Thomas

*Attorney, Agent, or Firm*—Learman & McCulloch

[57] ABSTRACT

A combination bicycle training and workstand frame assembly for a bicycle, in one mode, consists of a rear axle supporting frame, having a first arm section with one end interfittable with a bicycle rear axle, and a second arm section extending generally perpendicular thereto. A front wheel fork assembly supporting frame is connected to the second arm section, to extend generally perpendicularly thereto, and has an adapter holder adaptable to support a bicycle front wheel fork assembly in elevated position. Torque resisting mechanism has an endless belt supported to engage the surfaces of the rear tire, and includes mechanism for urging the belt against the rear tire to impose a torque resisting force. The adapter holder, in the second mode of use of the stand, when the stand parts are rotated 90° and are to function as a work stand for supporting a bicycle by its cross bar, functions as a clamp wall. A clamp is mountable on the front wheel fork assembly supporting frame and is cooperable with the holder for grasping the cross bar of the bicycle.

14 Claims, 5 Drawing Sheets

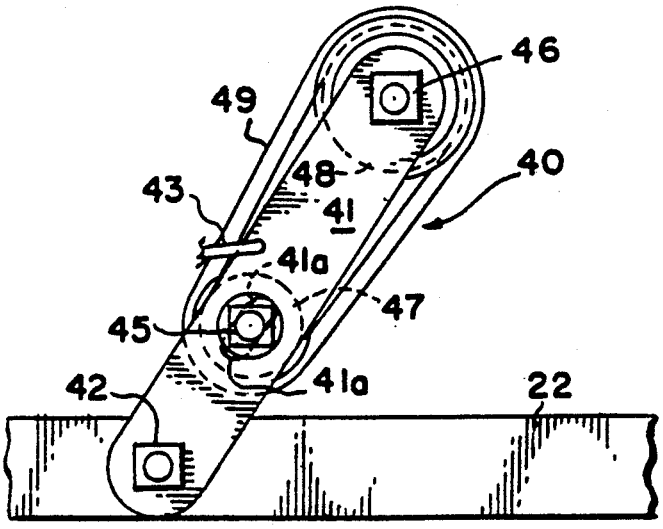
FIG. 4
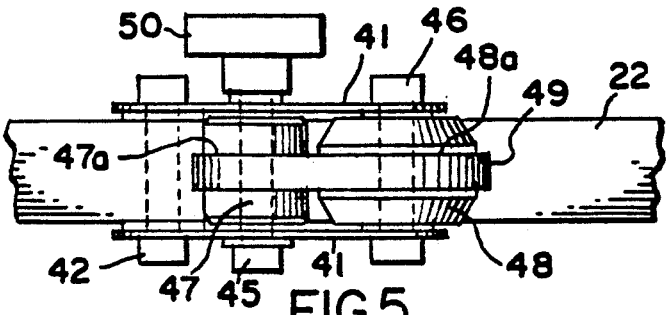
FIG. 5
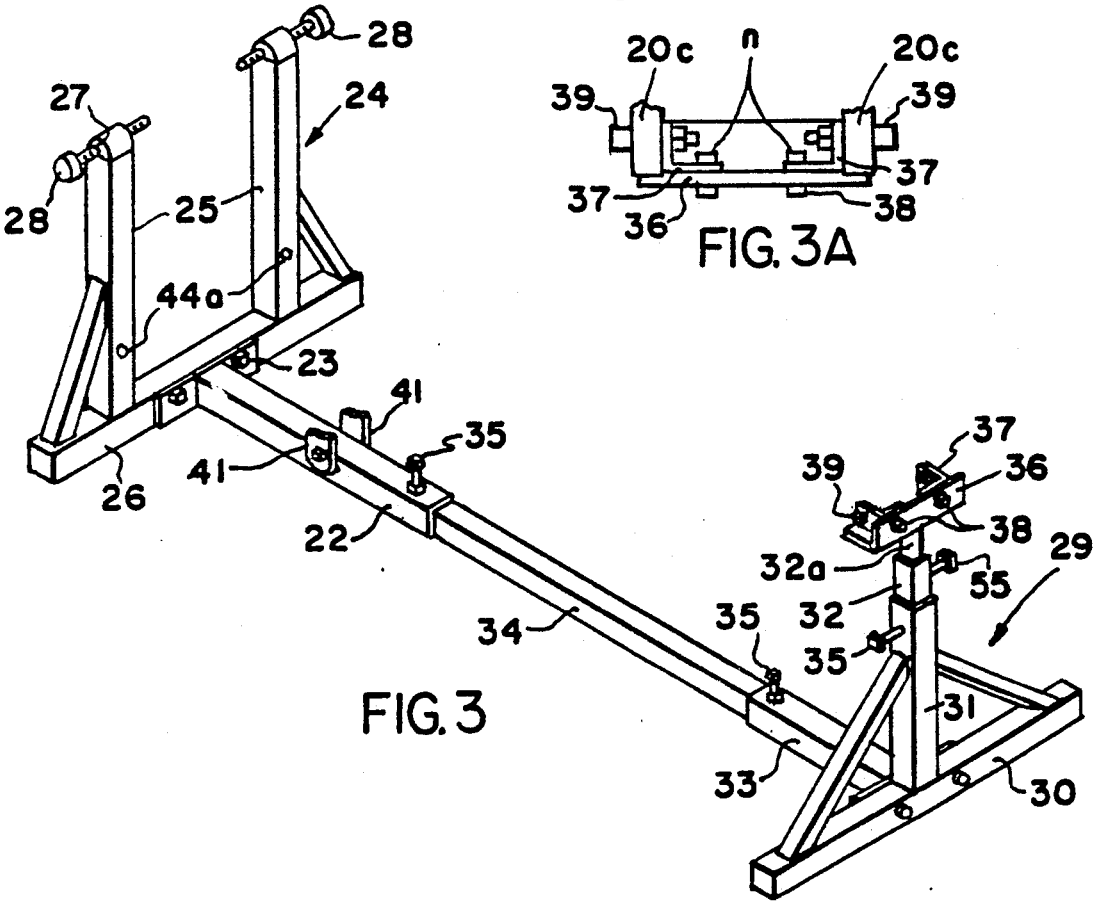
FIG. 3
FIG. 3A

INTERCHANGEABLE DUAL POSITION TRAINING STAND AND WORK STAND FOR BICYCLISTS

This invention relates to combination training stands and work stands which are convertible one to the other, and more particularly, to stands which are particularly useful with mountain bikes and other bikes having the knobby tires used for off-road travel.

BACKGROUND OF THE INVENTION

Previously, work stands and training stands have been separately provided and a bicyclist desiring both has had to purchase two separate products. To the best of my knowledge, moreover, the training stands which have been proposed, wherein the rear wheel is in engagement with a revolvable wheel support member, have been of such design that, particularly with knobby tires, there has been considerable tire wear and a high degree of undesirable operating noise.

SUMMARY OF THE INVENTION

The present invention is concerned with component assemblies, useful as both a training stand and work stand, which are interfittable to securely support a bicycle in a manner to permit work to be done on it, while in another configuration, supporting a bicycle in a position in which it can be ridden by a bicyclist maintaining a training regimen when outdoor riding is prohibited by outside weather or other conditions.

One of the prime object of the present invention is to provide a combination training stand and work stand which can be shifted rapidly from work stand configuration to either of two training stand configurations to provide the versatility desired by serious bicyclists.

Another advantage of the invention is to provide a combination stand which can be economically marketed, using common components which function differently in the training stand and work stand environments.

Still another object of the invention is to provide a product of the type described wherein mountain bike enthusiasts can train indoors with less wear on the tires, less noise, and with a more consistent force pedaling stroke.

Still a further object of the invention is to provide a durable convertible product whose component parts can be readily changed from either the work stand or training stand configuration in a reliable manner, without the need for expensive special tools.

Another objects and advantages of the invention will be pointed out specifically, or will become apparent from the following description when it is considered in conjunction with the appended claims and the accompanying drawings.

THE DRAWINGS

FIG. 3 is a perspective, elevational view of the stand only;

FIG. 3A is an enlarged fragmentary, sectional plan view of the front wheel fork receiving parts only;

FIG. 4 is a fragmentary, enlarged, side elevational view of the torque resistor assembly only;

FIG. 5 is a top plan view thereof;

Figure 2:
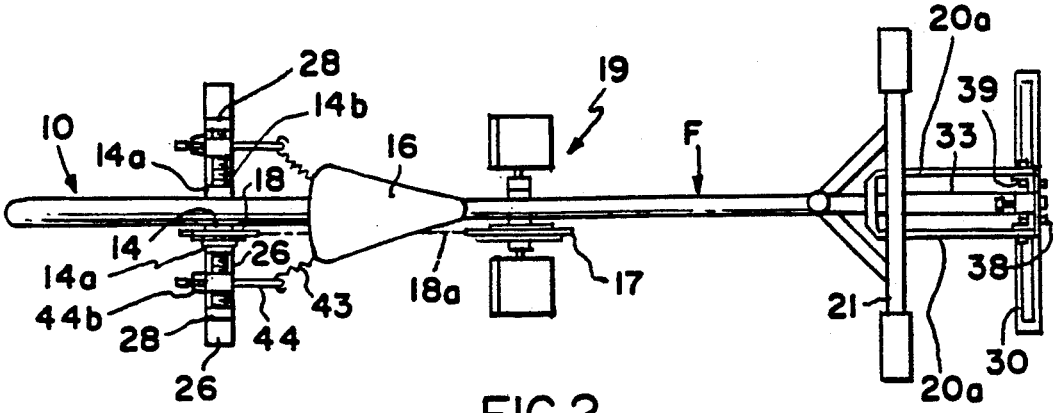
FIG. 2 is a top plan view thereof.

Referring now more particularly to the accompanying drawings, and in the first instance to FIGS. 1–5, a bicycle of conventional design is illustrated and shown supported on the training-work stand of the present invention. The bicycle illustrated is of the off-road variety, and includes a rear wheel 10, including a rim 11, on which a knobby tire 12, having an array of peripheral knobs **12*a*, is mounted in the usual manner. The rim 11 is supported by spokes 13 from an axle 14 which, as usual, has protrudent threaded posts 14*a***.

The frame F of the bicycle includes a rear axle support portion **15*a*, a member 15, mounting a seat 16 at its upper end, and a sprocket 17 on its lower end. The sprocket 17 is connected in the usual manner with a wheel driving sprocket 18, journaled on axle 14, by a chain 18*a*, through a system of gears which vary the wheel drive characteristics. Foot pedal assembly 19 is connected in the usual manner to rotate sprocket 17**.

It is to be understood that the bicycle is of conventional construction and need not be specifically illustrated or described. The frame F further includes upper and lower cross bars **15*b* and 15*c* and a front wheel fork assembly 20, mounting a handlebar 21, which at its lower end has fork members 20*a* with the usual front axle receiving slots 20*b* in fittings 20*c***.

Figure 1:
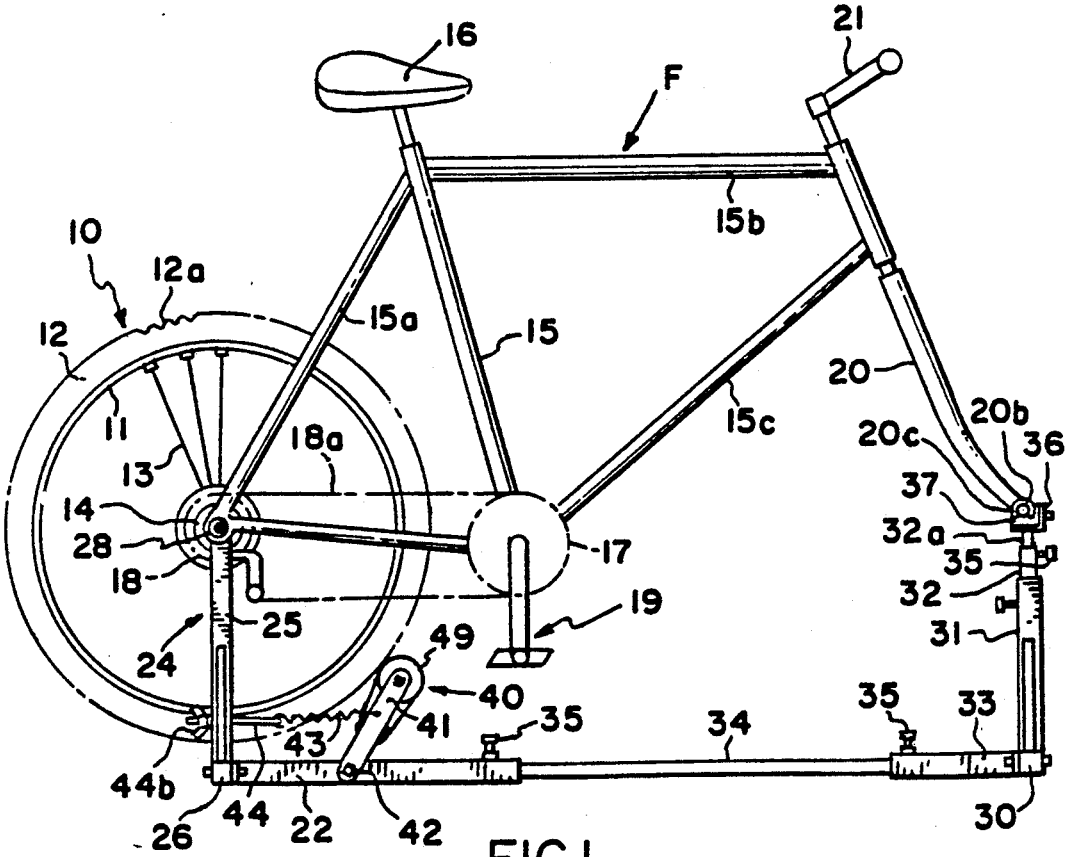
FIG. 1 is a side elevational view, showing a bike supported in a training stand mode wherein the front wheel is removed from the wheel forks.

The stand, generally designated S, includes a right angular support, comprising tubular member 22 which is bolted as at 23 (FIG. 3), to a composite upright rear axle support structure 24, which, in the FIG. 1 configuration, is vertically disposed and has braced upright members 25 fixed to a transverse base 26. The upper ends of members 25 have threaded openings 27, for receiving the bolts 28 which are received in threaded openings **14*b* provided axially in the axle posts 14*a* to firmly support the axle 14 and bicycle rear wheel 10**.

A similar support assembly, generally designated 29, is provided to support the bicycle front wheel forks 20, and includes a transverse base member 30 and braced front wheel fork support upright. The assembly 29 further includes a tubular connector member 33, which telescopically receives an extender member 34, which is further received telescopically in the end of tube 22. Set screws 35 secure the component parts in assembled relation.

Received telescopically in the upper end of upright 31, is a tubular extender 32 which, rotatably receives a post **32*a* fixed to an adaptive angle support or holder member 36, having a pair of angular mount brackets 37, provided thereon in the use depicted in FIGS. 1 and 2. Set screws 35 retain the extender 32 in vertically adjusted position and the post 32*a* in rotatably adjusted position. The angle members 37 are secured to the member 36 by bolts 38, and each member 37 carries a protrudant bolt 39 in an opening for receiving the slotted lower end (20***b*) of a wheel fork 20*a*. The nuts n for retaining the bolts 38 and 39 are preferably welded to the angle members 37 to facilitate tightening down of the bolts 38 and 39.

Provided on the member 22, to impose a load on tire 12, is a torque resistor assembly, generally designated 40 (see FIGS. 4 and 5), which is particularly configured to reduce noise and tire wear. The assembly comprises a pair of inclined arms 41, which are received on a bolt 42 so as to be pivotal thereon. Releasable springs 43 (FIGS. 1 and 2) extending through openings 44*a* in members 25, secured to the arms 41, connect to a pair of threaded rods 44 fixed to the member 24 by wing nuts 44*b*. Secured between the arms 41 are a pair of bolts 45 and 46, on which a pair of grooved roller bearing assemblies 47 and 48 are rotatably secured. A non-elastic corded fabric belt 49 is received in the grooves 47*a* and 48*a* provided in the bearings 47 and 48.

To permit adjustment of the tension on belt 49, both arms 41 have slots 41*a* within which bolt 45 is received, and a hand-operated nut 50 can be threaded on the threaded end of bolt 45, so as to be tightenable down upon the one arm 41 to hold the bolt 45 in a particular adjusted position within slots 41*a*. This permits adjustment of the belt tension, and adjustment of the belt 49 for wear, should this be necessary.

The springs 43 urge the arms 41 to pivot counterclockwisely in FIG. 1, and to urge belt 49 to engage the tire 12 with a predetermined tension or load. Because rotation of the tire 12, as pedal assembly 19 is operated by the bicyclist, causes the belt 49 to travel, tire wear is minimized and the knobs 12*a* do not cause undue noise as the tire rotates. In fact, noise, measured on a decibel basis, is cut approximately in half with the use of the presnt bike stand, where knobby tires are involved.

Figure 7:
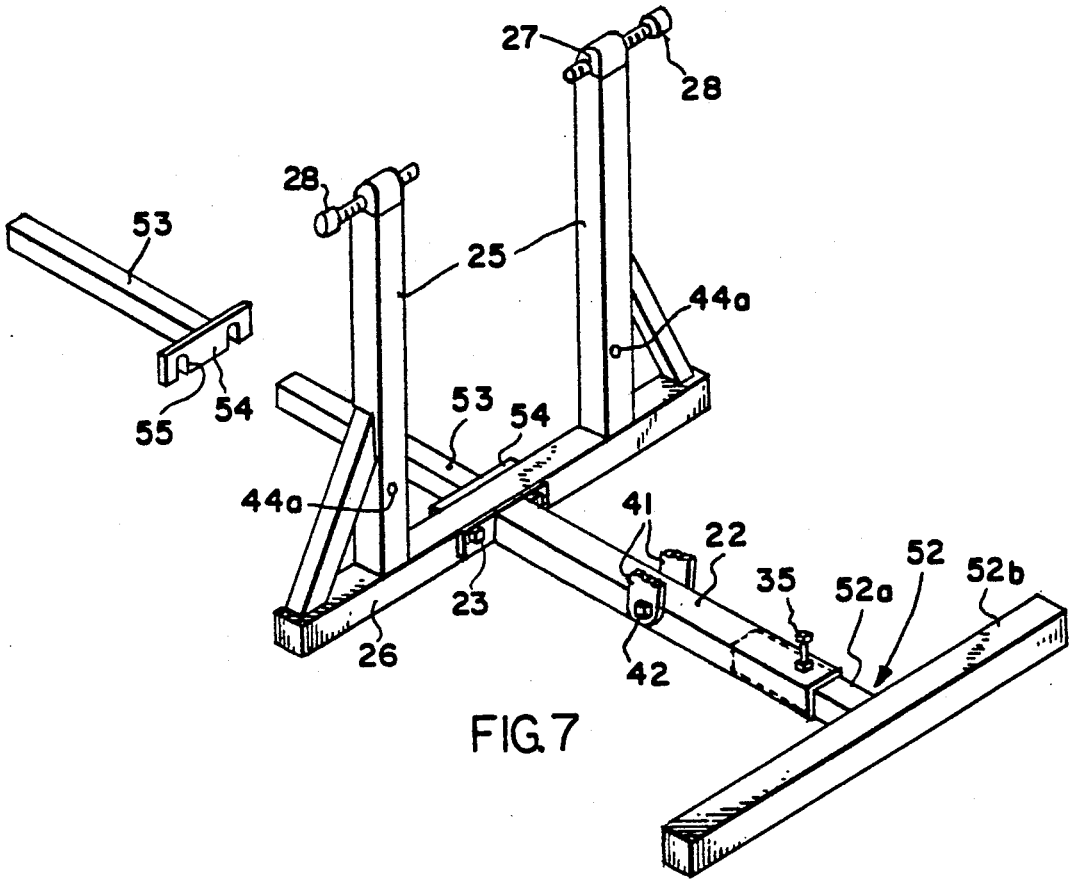
FIG. 7 is a perspective, side elevational view of the stand only.
Figure 6:
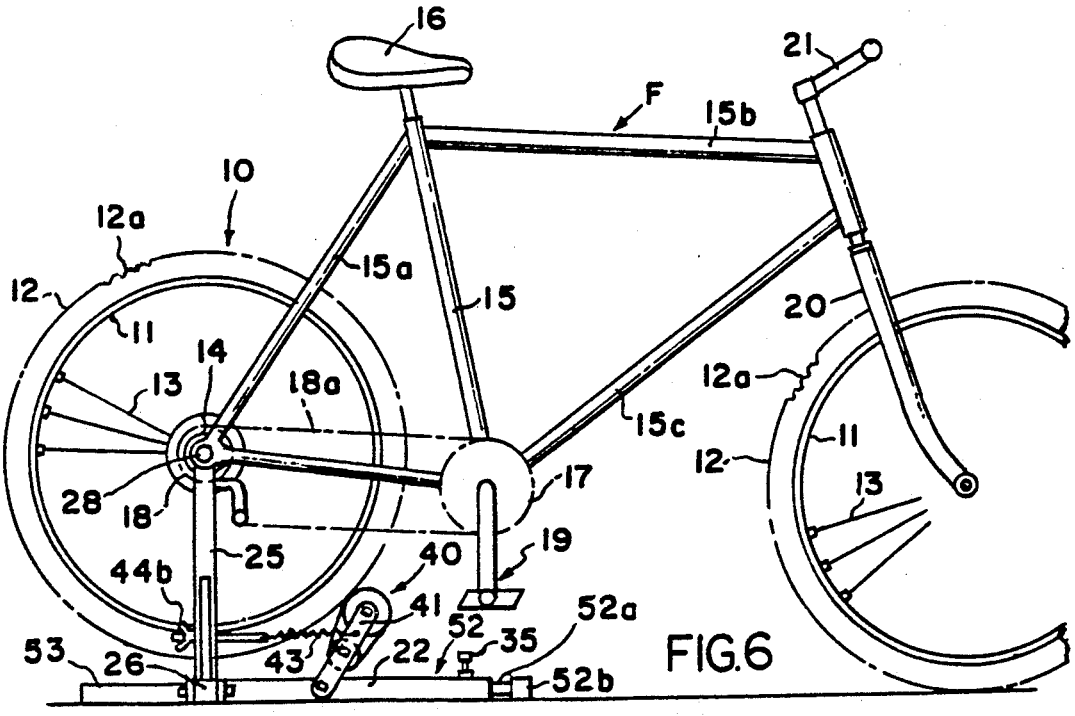
FIG. 6 is a side elevational view showing the training stand in another configuration in which the front wheel remains on the bicycle in engagement with the ground surface.

In FIG. 6, the stand is set up to be operable as a training stand which does not require removal of the bicycle front wheel. In this configuration, the extender bar 34, and assembly 29 is replaced by a T-bar, generally designated 52. The T-bar 52 includes a stem 52*a*, received telescopically within member 22, and a lateral support base 52*b*. In addition, a rear extension, designated 53, has a front plate 54 with downwardly opening slots 55 received by the nuts on bolts 23. The slots 55 are of the configuration of the nuts, and slide down over them to hold the rear extender 53 securely in position without permitting rotation. In FIGS. 6 and 7, parts corresponding to the parts illustrated in FIGS. 1–5, have been designated by like numerals for simplicity of description.

Figure 9:
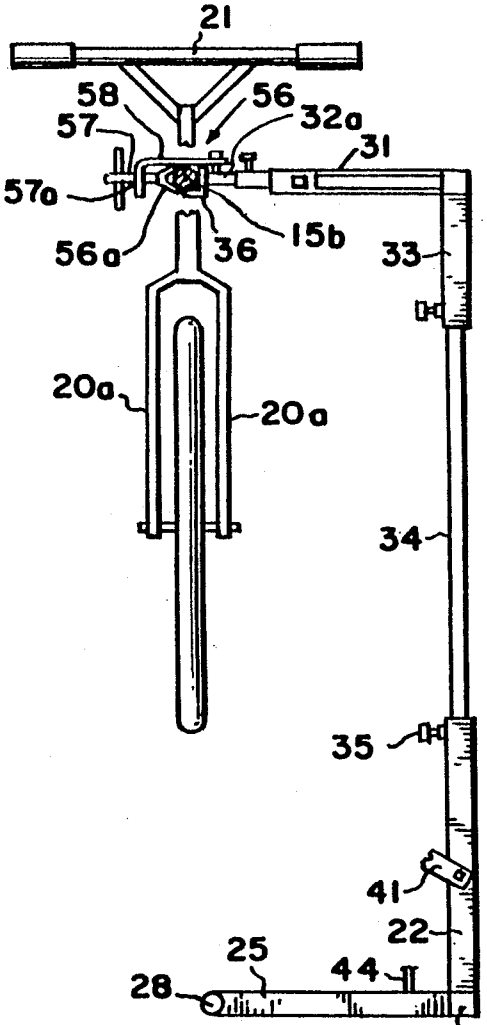
FIG. 9 is an end elevational view thereof.
Figure 8:
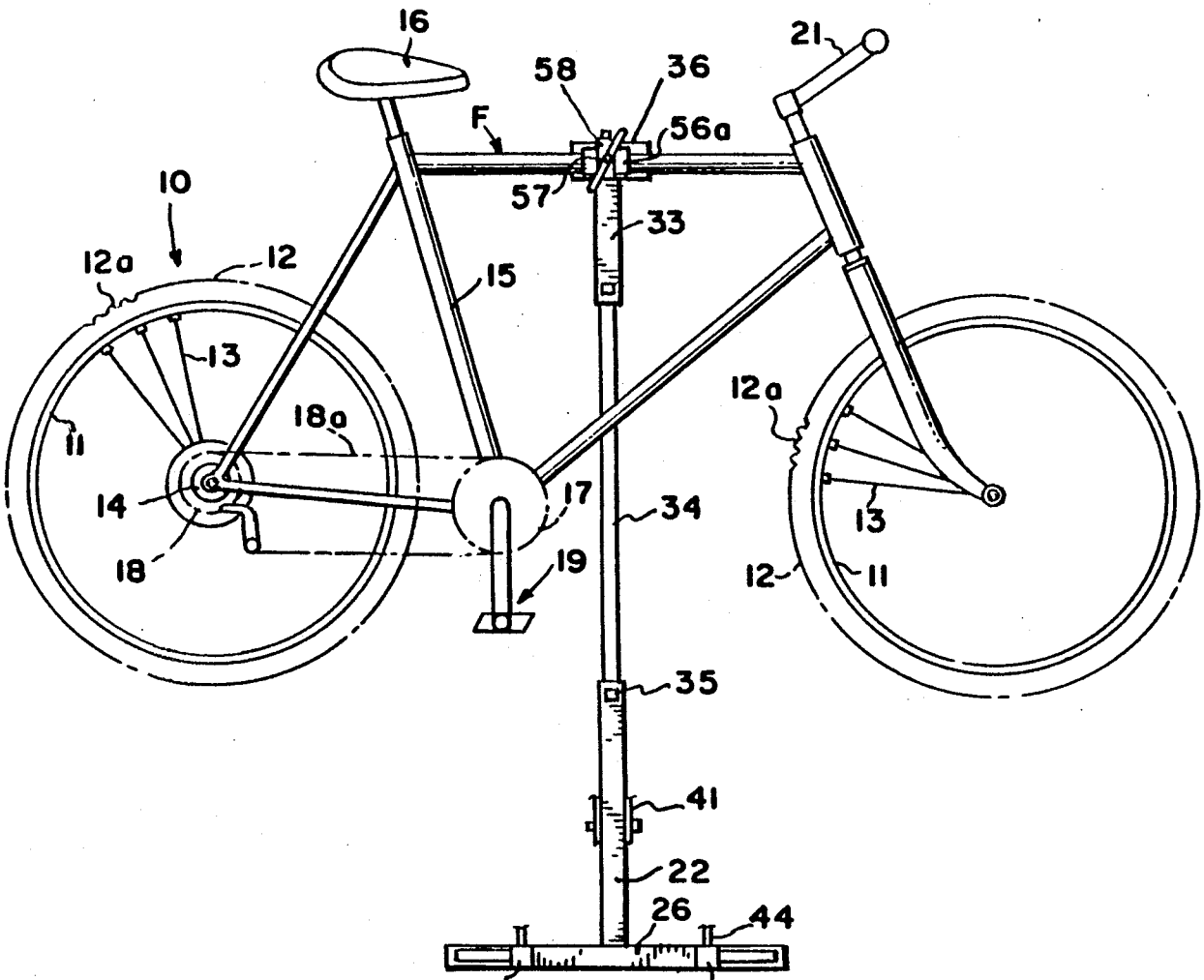
FIG. 8 is a side elevational view, showing the stand set up as a work stand supporting a bicycle in an elevated position to enable work to be performed on it.
Figure 10:
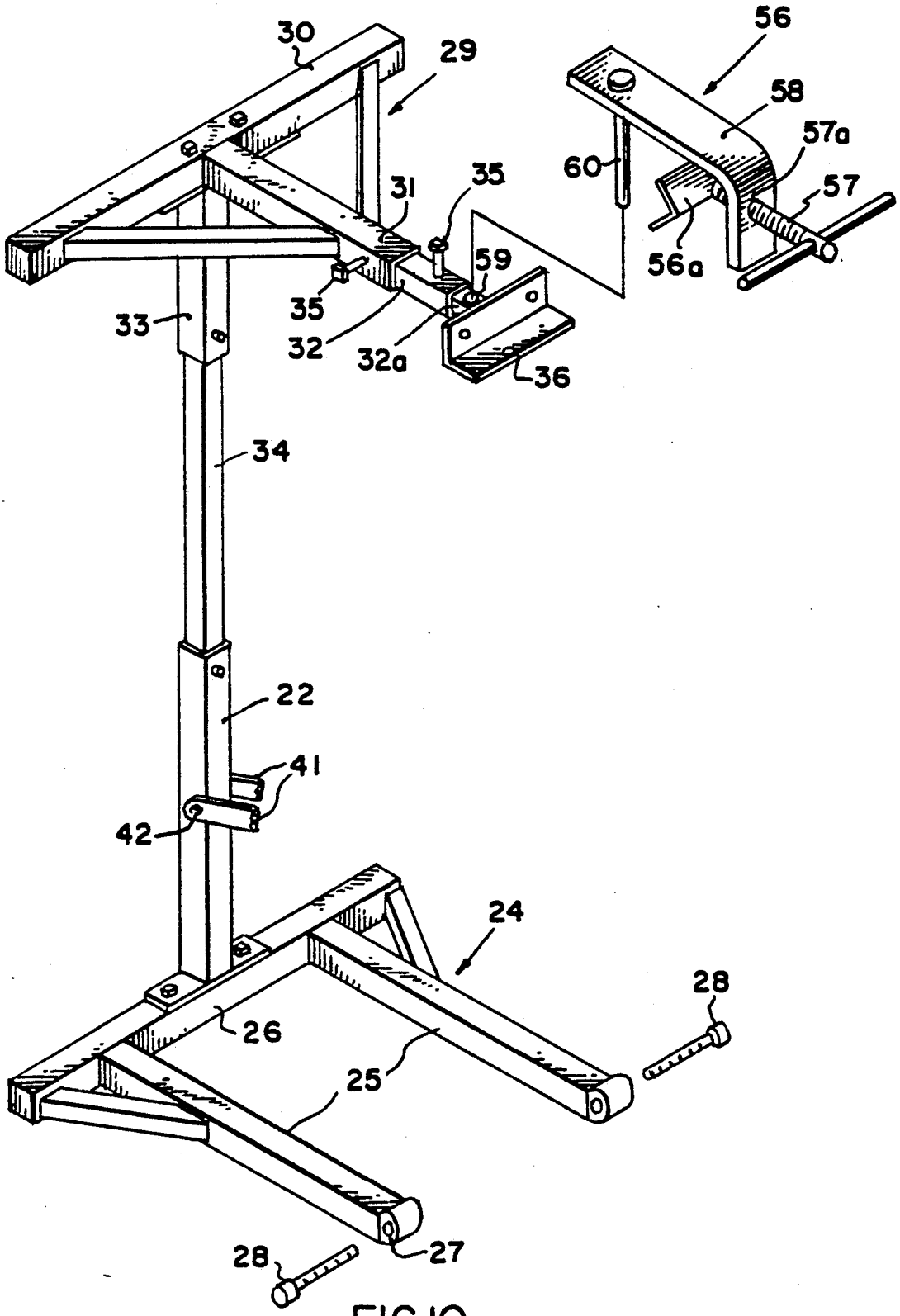
FIG. 10 is a perspective, elevational view, with some of the parts of the stand removed and separated to better illustrate them.

Likewise in FIG. 8–10, similar numerals are utilized to designate the parts which have been previously described. As FIG. 10 particularly indicates, when the device is to be used as a work stand to support the bicycle in elevated position, as shown in FIG. 8 and 9, a clamp attachment, generally designated 56, is utilized. The attachment 56 includes a V-shaped clamp 56*a*, carried opposite the angle 36 on a handle operated threaded post 57, post 57 being threadably received in a threaded opening 57*a* provided in an angular strap 58. An opening 59 provided in the post member 32*a* receives dependent pin 60, which is fixed to the strap 58*a*.

THE OPERATION

In FIGS. 1 and 2, the front wheel of the bicycle, including its front axle, has been removed to expose the slots 20*b* in the lower ends of fork members 20. The angle members 37, with their protrudant bolt ends 39, are in place on the adapter holder member 36 and the slots 20*b* are received on bolts 29, with clevises 20*c* engaged between the heads of the bolts 39 and the angles 37, as disclosed in FIG. 3*a*.

The telescoped position of member 32 is adjusted to support the bicycle either in level position or at the desired position of tilt. In this position, the rear wheel axle 14 is supported on the threaded bolt members 20*a*, which are received in the threaded axle openings 14*b*. Bolt 45 is in a proper position to tension the belt 49 efficiently so that when the belt 49 is pulled against the rear tire 12 by springs 43, the desired resistance to rotation is imparted to tire 12.

When it is desired to use the training stand in the mode indicated in FIG. 6, in which the front tire 12 remains in place on the bicycle, the extender 34 and member 29 are removed from the tubular bar 22, and T-bar 52 is substituted to provide the proper lateral support. To lengthen out the base support, the member 53 is placed in position as shown in FIG. 7, with the slots 55 engaging over the nuts n securing bolts 23.

When it is desired to use the training stand in a work stand mode, and assuming the training stand is in the FIGS. 1 and 2 configuration, the angles 37 are removed from the adapter support 36 by removing bolts 38. When the stand is then rotated 90° to the position shown in FIGS. 8 and 9, the clamp assembly 56 is readily placed in position by simply inserting the pin 60 in the opening 59. In this position of the parts, the member 32 is generally retracted somewhat into member 31, to reduce the cantilever effect and the member 32*a* is rotated to the desired position to tilt angles 36 and 56*a* to the desired position. The tightening of bolts 35 will then secure all these members in position and, when the bicycle top cross bar is lifted to a position between the angles 36 and 56*a*, the screw member 57 may be manipulated to clamp the top cross bar securely between the members 36 and 56*a*, as shown in FIGS. 8 and 9.

While one embodiment of the invention has been described in detail, it will be apparent to those skilled in the art that the disclosed embodiment may be modified. Therefore, the foregoing description in all aspects is to be considered exemplary rather than limiting in any way, and the true scope of the invention is that defined in the following claims.

What is claimed is:

1. A combination bicycle training and work stand frame assembly for a bicycle having a frame supporting a rear wheel axle and rear wheel with a tire, and a front wheel fork, the bicycle frame having a cross bar comprising:

a. a rear axle supporting frame having a first arm section with means at one end interfittable with a bicycle rear axle for supporting the rear axle of a bicycle rear wheel in elevated position, said frame having a second arm section extending generally perpendicularly to said first arm section for engaging the ground and supporting the first arm section in stable position when the first arm section is in upright rear axle supporting position;

b. torque resisting mechanism supported on said second arm section and having a first end connected thereto, and a second end adjacent the outer peripheral surface of said tire;

c. said torque resisting mechanism having a movable endless surface supported on its second end for engaging said surface of the tire, and having means for urging said endless surface against the said rear wheel tire to impose a torque resisting force thereon;

d. a front wheel fork assembly supporting frame, connected to said second arm section to extend generally perpendicularly thereto parallel to said rear axle supporting frame, and having a combination support and clamp part adaptable for supporting a bicycle front wheel fork assembly in elevated position; and e. clamp means, cooperable with said combination part for grasping the cross bar of the bicycle, received on the end of said front wheel fork assembly supporting frame opposite said combination support and clamp part when said frame assembly is rotated ninety degrees so that said first arm section of the rear axle supporting frame is in engagement with the ground and said frame assembly is used as a work stand on which the bicycle is supported solely by its cross bar.

2. The stand of claim 1 wherein said front wheel fork assembly supporting frame includes a tubular member with a first post telescopically received therein, and means for locking said post in various positions of extension.

3. The stand of claim 2 wherein said first post is tubular and receives a second post rotatably therein; said second post having said combination support and clamp part thereon, means for supporting said second post and combination part in a position of rotary adjustment in said first post; and said clamp means comprising an opposing clamp part mounted on said second post to rotate therewith.

4. The stand of claim 3 wherein said second post has an opening and said opposing clamp part has a clamp support strap with a pin received by said second post to position said clamp part; said clamp part including a clamp piece and screw means on which said clamp piece is mounted, reactable with said strap, for moving said clamp piece toward and away from said combination part.

5. The stand of claim 4 wherein said combination part and clamp piece comprise oppositely facing angle members forming a socket for the cross bar of the bicycle.

6. The stand of claim 5 wherein said front wheel fork assembly includes a wheel fork with bifurcated legs having sockets at their lower ends, and said combination support and clamp part has openings for supporting removable pin means for receiving the sockets in the front wheel forks of the bicycle when the stand is being used as a training stand.

7. The stand of claim 1 wherein said torque resisting mechanism is pivotally supported on said second arm section and spring means extending between said torque resisting mechanism and first arm section urges said endless member against the rear wheel tire when the frame assembly is in use as a training stand.

8. The stand of claim 7 wherein said endless member comprises a belt extending generally tangentially to said rear tire and is trained around a pair of rollers mounted on said torque resisting mechanism.

9. The stand of claim 8 wherein said belt is a fabric belt.

10. The stand of claim 9 wherein mechanism mounts said rollers for adjusting movement toward and away from each other, and means is provided for anchoring at least one of said rollers in adjusted position.

11. A bicycle training frame assembly for a bicycle driven by a pedal sprocket having a frame supporting a rear wheel axle with a wheel and tire and a front wheel fork, the bicycle frame having a cross bar comprising:

a. a rear axle supporting frame having a first arm section with means at one end interfittable with a bicycle rear axle for supporting the rear axle of the bicycle in elevated position, said frame having a second arm section extending generally perpendicular to said first arm section for engaging the ground, and stably supporting the first arm section;

b. a longitudinally extending lever structure pivotally supported on said second arm section rearward of said sprocket and adjacent to said rear wheel;

c. a pair of longitudinally spaced apart in-line roller bearings rotatably mounted on said lever structure and having peripheral surfaces with longitudinally aligned grooves thereon;

d. a movable endless fabric belt, having substantially linear run portions supported and maintained by said pair of spaced apart bearings, trained around said bearings and situated in the grooves in said bearings, said run portions projecting radially of said peripheral surfaces of the bearings, and one of the run portions extending generally tangentially to the periphery of said tire on the rear wheel in engagement therewith; and e. yeildable, energy storing means connected between said lever structure and said stand for urging said run of the belt against the said rear wheel tire to impose a relatively noise-free torque-resisting force thereon as said one run portion of the belt is caused to travel generally linearly between said bearings by the rotation of the rear wheel tire.

12. The stand of claim 11 wherein said belt is a corded fabric belt.

13. The stand of claim 11 wherein mechanism mounts said bearings for adjusting movement toward and away from each other, and means is provided for anchoring at least one of said bearing members in adjusted position.

14. A method of using a combination bicycle training and work stand frame assembly for a bicycle having a frame mounting a rear axle for a rear wheel on which a tire is mounted, a front wheel fork, and a cross bar; said stand comprising a rear axle supporting frame, having a first arm section with means detachably interfitting with a bicycle rear axle and supporting the rear axle of a bicycle rear wheel in elevated position, said rear axle supporting frame having a second arm section extending generally perpendicularly to said first arm section engaging the ground and supporting the first ar section in stable position when the first arm section is in an upright, axle supporting position; torque-resisting mechanisms supported on said second arm section having a first end connected thereto and a second end adjacent the outer peripheral surface of said tire, said torque-resisting mechanism having a movable endless surface supported on its second end to engage said surface of the tire, and means for urging said endless member against the said rear wheel tire to impose a torque-resisting force thereon, a front wheel fork assembly supporting frame connected to said second arm section to extend generally perpendicularly thereto, parallel to said rear axle supporting frame, and having a support part engaged to support a bicycle front wheel fork assembly in elevated position; and detached clamp means for engaging the cross bar of the bicycle, receivable on the end of said front wheel fork assembly supporting frame, and operable when said frame assembly is rotated 90° so that said first arm section of the rear axle supporting frame is in engagement with the ground, the steps of:

a. disengaging the interfitting means on the first arm section from the rear axle of a bicycle, and the front wheel fork structure from the front wheel fork structure supporting frame;

b. rotating said frame assembly through 90° so that the said first arm section of the rear axle supporting frame is in engagement with the ground;

c. mounting said clamp means on the front wheel fork assembly supporting frame;

d. raising a bicycle to dispose its cross bar between the support part and clamp means; and e. manipulating said clamp means to grasp the cross bar of the bicycle and clamp it against said support part, so that the bicycle is supported solely by its cross bar.

* * * * *

UNITED STATES PATENT AND TRADEMARK OFFICE

CERTIFICATE OF CORRECTION

PATENT NO. : 5,042,795

DATED : August 27, 1991

INVENTOR(S) : Thomas A. Bursik

It is certified that error appears in the above-identified patent and that said Letters Patent is hereby corrected as shown below:

In column 2, line 68, after "opening" insert -- 39a --.

In column 6, line 51, change "ar" to -- arm --.

Signed and Sealed this

Nineteenth Day of January, 1993

*Attest:*

DOUGLAS B. COMER

*Attesting Officer*

*Acting Commissioner of Patents and Trademarks*